United States Patent [19]

Schnyder

[11] 3,941,650

[45] Mar. 2, 1976

[54] CONTINUOUS DIGESTER

[76] Inventor: Auxilius P. Schnyder, 146 Cherry Lane, Teaneck, N.J. 07666

[22] Filed: Aug. 9, 1974

[21] Appl. No.: 496,305

[52] U.S. Cl. ..... 162/237; 23/290.5; 162/246; 162/249; 162/251; 162/274; 209/379; 210/412; 210/413

[51] Int. Cl.[2] ..... D21C 7/00

[58] Field of Search ..... 162/237, 251, 246, 249, 162/272, 274; 23/290.5; 210/407, 409, 411, 412, 413, 415; 209/273, 379, 389

[56] References Cited

UNITED STATES PATENTS

| | | | |
|---|---|---|---|
| 3,755,072 | 8/1973 | Ostberg et al. | 162/237 |
| 3,802,956 | 4/1974 | Backlund | 162/237 |
| 3,811,994 | 5/1974 | Ostberg | 162/237 |

FOREIGN PATENTS OR APPLICATIONS

| | | | |
|---|---|---|---|
| 663,338 | 5/1963 | Canada | 162/251 |

*Primary Examiner*—S. Leon Bashore
*Assistant Examiner*—George C. Yeung
*Attorney, Agent, or Firm*—Marn & Jangarathis

[57] ABSTRACT

A continuous digester in which liquor is drained, at various levels, through a screen into a compartment formed by half rings attached to the interior of the digester. The compartment is provided with rotating vanes, which backwash the screen by pulsing liquid therethrough. The digester includes a lower cone, provided with an impeller and compartment for introducing and circulating liquor for "cold blow" of product.

10 Claims, 3 Drawing Figures

CONTINUOUS DIGESTER

This invention relates to the digestion of cellulosic materials, and more particularly to a new and improved continuous digester for cellulosic materials.

There are several different continuous digester designs on the market. Although such continuous digesters have met with some success, there is still a need for new and improved continuous digester designs.

The principal object of the present invention is to provide a new and improved continuous digester.

In accordance with the present invention, there is provided a continuous digester which is based on a batch digester design and includes improved assemblies for introducing and withdrawing liquor. More particularly, liquor is drained from the digester at various points through liquor drainer compartments in fluid flow communication with the interior of the vessel and separated therefrom by means which prevent solids from entering the drainer compartment, such as a screen. The compartment also includes means for continuously cleaning the screen to maintain the screen in a continuously open condition.

Liquor is introduced into the bottom of the digester for "cold blow" of the product through an improved assembly which includes an impeller for circulating the liquid in the bottom cone of the digester.

The invention will be described with respect to the preferred embodiment thereof illustrated in the accompanying drawings wherein.

Figure 1:
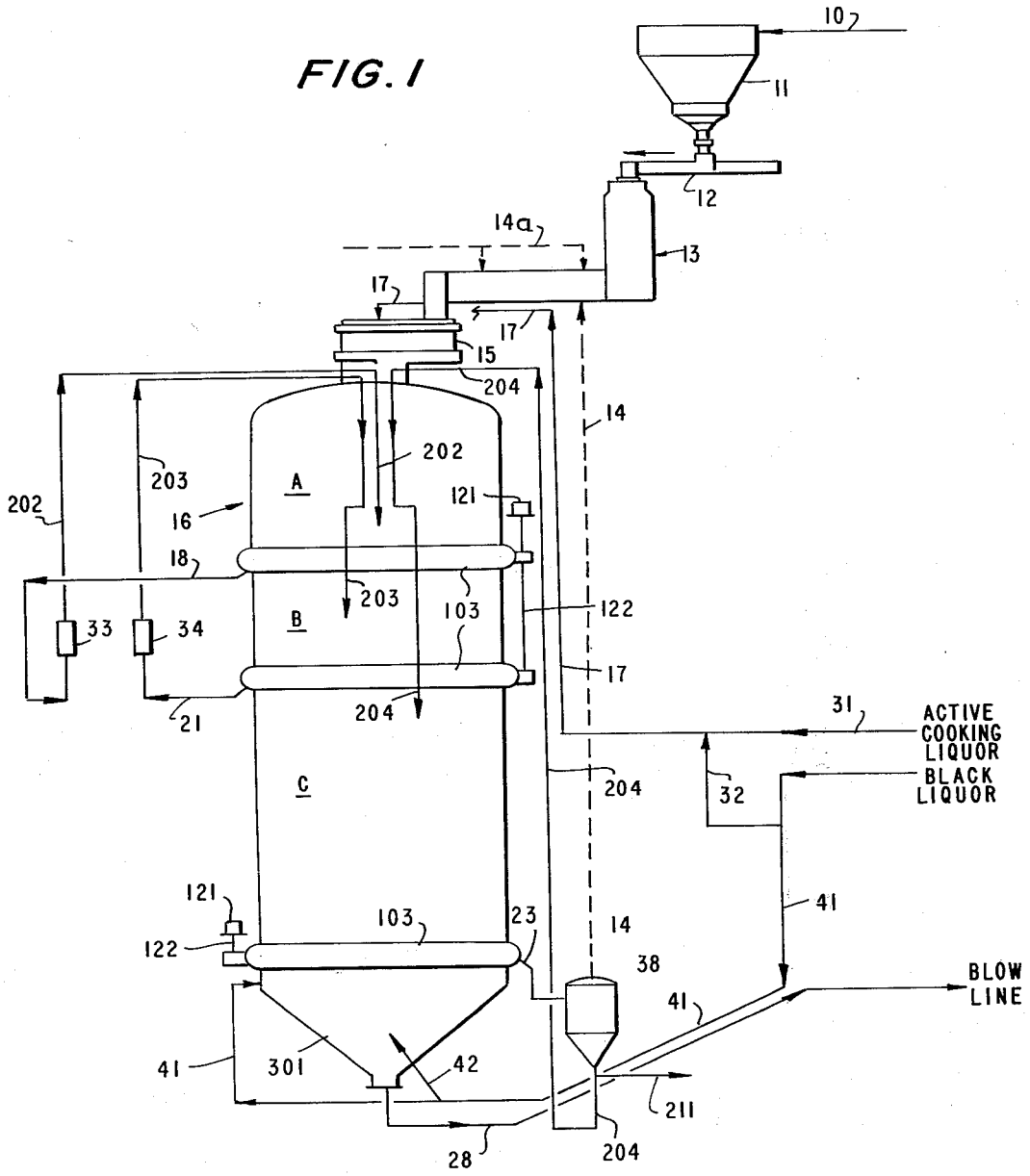
FIG. 1 is a simplified partially schematic representation of a digester incorporating teachings of the present invention.

Referring to FIG. 1, wood chips in line 10 are introduced into a storage bin 11 and are passed therefrom through a low pressure chip feeder 12 into a presteamer 13 wherein the chips are heated, by low pressure steam introduced through lines 14 and 14*a*. The preheated chips from presteamer 13 are introduced with cooking liquor in line 17 into a high pressure chip feeder 15, such as the type described in U.S. Pat. No. 3,224,606, positioned in the neck of digester 16. The chips and cooking liquor are passed into impregnation zone A of digester 16, which is further provided, at the lower portion, with liquor introduced through line 202. The impregnation zone A is operated as known in the art to impregnate the chips with cooking liquor. Excess cooking liquor is withdrawn at the bottom of the impregnation zone A through line 18, as hereinafter described.

The impregnated chips pass into a cooking or digestion zone B, of digester 10, which is provided with cooking liquor through line 203. The cooking zone B is operated at elevated temperatures and pressures, as known in the art; e.g., temperatures in the order of 300°F to 350°F and pressures in the order of 55 to 120 psig. Partially spent cooking liquor is withdrawn from the bottom of zone B through line 21, as hereinafter described.

The chips then pass through a prolonged cooking (simmering) zone C operated, as known in the art, at a temperature lower than zone B. The cooking zone C is provided with cooking liquor through line 204. Partially spent cooking liquor is withdrawn through line 23, as hereinafter described.

The digested chips then pass into the bottom cone of the digester 16, provided with cooled black liquor, through lines 41 and 42 for cold blow of the digested chips. The digested chips are withdrawn from digester 16 through line 28.

White liquor in line 31 is combined with black liquor in line 32 (the black liquor is mostly inactive and functions to temper the attack of white liquor on the chips) and the combined liquor in line 17 is introduced into chip feeder 15.

The liquor withdrawn through line 18 is heated in exchanger 33 and introduced into the digester through line 202. The liquor withdrawn through line 21 is heated in exchanger 34 and introduced into the digester through line 203.

The liquor withdrawn through line 23 is introduced into flash drum 38 wherein the liquor is flashed to provide steam for line 14. Flashed liquor withdrawn from tank 38 is introduced into the digester 16 through line 204. A portion of the flashed liquor is passed to black recovering through line 211.

The hereinabove description should be sufficient to understand the overall design and operation of the continuous digester 16. The invention will be further described with reference to FIG. 2 which illustrates a preferred embodiment of the assembly for draining liquor from the digester 16.

Figure 2:
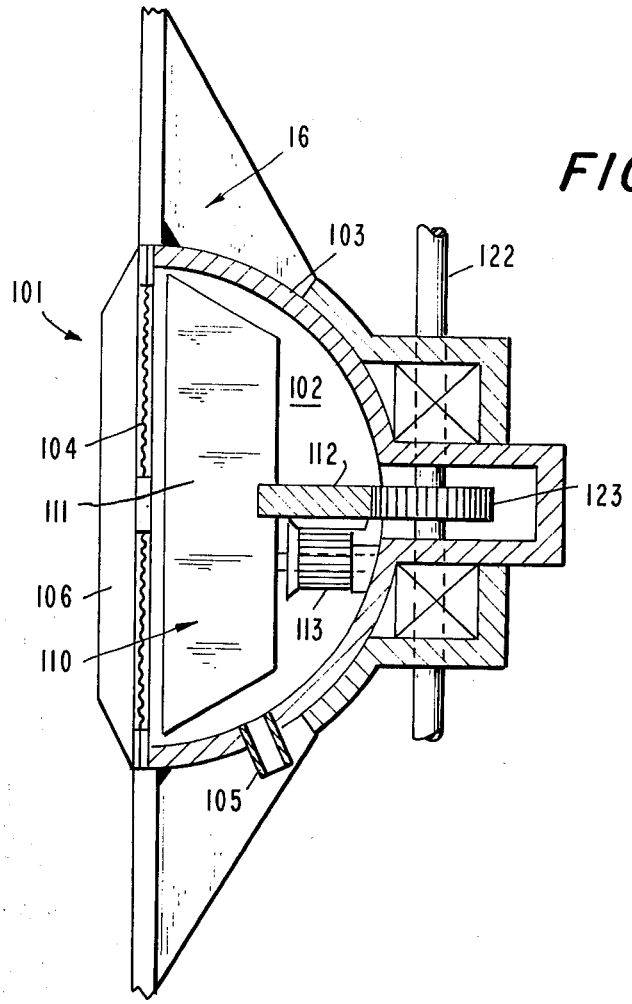
FIG. 2 is a partial sectional view of an embodiment of the digester liquor drainer assembly of the present invention.

Referring to FIG. 2, the assembly for draining liquor from the vessel, generally designated as 101, includes a drainer compartment 102, defined by an outer ring 103 in the form of a half pipe, secured to the exterior of the wall of the vessel 16, as by welding, and closing a cut in the vessel wall. A screen ring 104 separates the drainer compartment 102 from the interior of the digestion vessel 16, whereby liquor passes from the interior of the vessel 16 through the screen 104 into the drainer compartment 102. The screen is reinforced by a plurality of circumferentially spaced plates 106. The drainer compartment 102 is provided with an outlet pipe 105 for withdrawing liquor from the drainer compartment 102.

The drainer compartment 102 is provided with a screen cleaning assembly, generally indicated as 110, for backwashing the screen 104 to maintain same in a permanently open position. The screen cleaning assembly is comprised of a plurality of circumferentially spaced vertical extending blades or vanes 111, mounted for rotation adjacent to the screen 104. The blades 111 are fastened to a circular rack 112 which is rotatably supported by a plurality of aligned circumferentially spaced rollers 113, rotatably mounted on the interior of ring 103. The blades 111 are angularly positioned with respect to the screen 104, with the trailing edges thereof, being positioned closer to the screen 104.

The blades 111 are driven by a drive assembly comprised of a drive means, such as motor 121, (FIG. 1), a drive shaft 122 and spaced pinions 123 fixedly secured to the shaft 122 in driving engagement with racks 112. As particularly shown, the cleaning assembly for the rings of compartments A and B are driven through a single drive assembly, however, other arrangements are possible within the scope of the invention.

In operation, rotation of vanes 111, through the drive rack 112, by pinions 123, produces pulses in the liquor in compartment 102 which backwashes the screen 104, thereby maintaining the screen 104 free of solids which would normally clog the screen 104. The vanes 111 are spaced and rotated such that the overall direction of flow is from the interior of the digester 16 through screen 104, with portions of the screen 104 being periodically backwashed, as a vane 111 passes by the portion of the screen 104.

Figure 3:
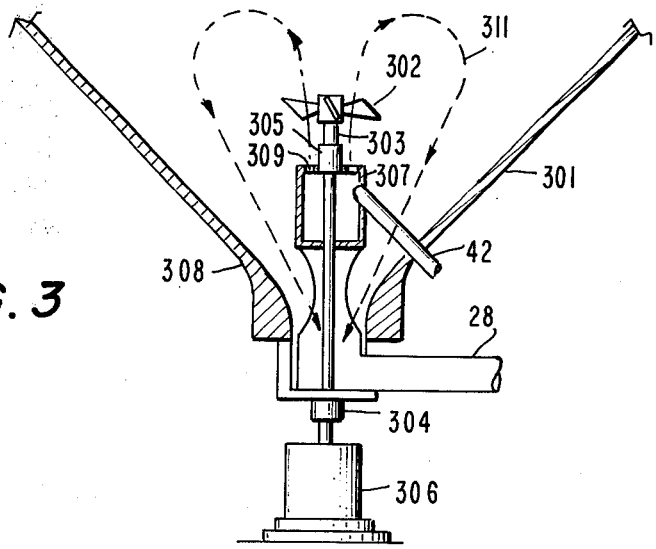
FIG. 3 is a sectional view of an embodiment of the lower cone assembly for the digester assembly of the present invention.

Referring to FIG. 3, there is illustrated the assembly for introducing black liquor into the bottom cone 301 of digester 16. The assembly for introducing black liquor into the cone of the digester to provide for cold blow is comprised of an impeller 302 mounted on shaft 303, suitably journaled in bearings 304 and 305 and driven by a drive means, such as motor 306. A housing 307, defining a chamber 308 for receiving black liquor, is supported immediately below impeller 302. The black liquor inlet pipe 42 introduces black liquor into housing 307, the top of which is provided with a plurality of orifices 309 for passing black liquor from chamber 308 into the interior of the digester 16, immediately below impeller 302.

The rotation of impeller 302 causes the black liquor to flow in the direction of arrows 311, thereby providing for cold blow of the digested chips from the interior of digester 16 through outlet pipe 28.

The digester of the present invention is particularly advantageous in that digestion can be effected on a continuous basis without the problems associated with removal of liquor from the digester. Moreover, improved cold blow of the digester is achieved by the improved lower assembly. Furthermore, by using the present design a batch digester may be easily converted to the continuous digester of the present invention, e.g., by making horizontal cuts in the batch digester, at the appropriate level, and inserting the drainer ring assembly at the cut.

Numerous modifications and variations of the present invention are possible in light of the above teachings and, therefore, within the scope of the present claims the invention may be practiced otherwise than as particularly described.

What is claimed is:

1. A continuous digester for comprising:

a vessel; means for introducing chips into the upper portion of the vessel; means for introducing fresh cooking liquor into said upper portion of said vessel; means for withdrawing digested wood chips from the lower part of the vessel; and liquor withdrawing means positioned at vertically spaced points in said vessel, each said liquor withdrawing means comprising a circumferential disposed liquor drain compartment in fluid flow communication with the vessel interior; a screen positioned between the interior of the vessel and said liquor drain compartment whereby liquor flows from the interior of the vessel through said screen into said liquor drain compartment; and screen cleaning means positioned in said drain compartment for circumferential movement thereby backwashing said screen to prevent plugging of said screen.

2. The continuous digester of claim 1 wherein the drain compartment is defined by an outer ring secured to the exterior of the vessel, said ring closing an excised portion of the vessel.

3. The continuous digester of claim 2 wherein said screen cleaning means comprises a plurality of circumferentially spaced vanes positioned in the drainer compartment adjacent to said screen, and means for rotating said vanes to produce pulses in the liquor in the drainer compartment to backwash the screen.

4. The continuous digester of claim 3 wherein said vanes are positioned transverse to said screen.

5. The continuous digester of claim 4 wherein the means for rotating the vanes comprises a circular rack, said vanes being mounted on the rack; means for rotatably supporting said rack, and means for rotatably driving said rack.

6. The continuous digester of claim 5 wherin said means for rotatably driving said rack comprises a shaft, a pinion mounted on said shaft and in engagement with the rack and means for rotating the shaft.

7. The continuous digester of claim 6 wherein the means for rotatably supporting said rack comprises a plurality of circumferentially spaced rollers.

8. The continuous digester of claim 1 wherein the vessel includes a bottom conically shaped portion, said means for withdrawing liquor being connected to the bottom conical portion and further comprising, an impeller within the vessel in said lower conical portion; drive means for rotating said impeller; and means for introducing liquor into the lower conical portion of the vessel immediately below said impeller.

9. The digester of claim 8 wherein the means for introducing liquor into the lower conical portion of said vessel comprises, a housing in the lower conical portion of said vessel positioned immediately below said impeller, said housing including a plurality of orifices for introducing liquor from the housing into the vessel immediately below the impeller; and inlet means for introducing liquor into the housing.

10. The digester of claim 9 wherein the drive means for the impeller includes a vertical shaft, said vertical shaft extending into the conical portion of the housing, said impeller being mounted on said shaft.

* * * * *